US006364558B1

(12) United States Patent
To

(10) Patent No.: US 6,364,558 B1
(45) Date of Patent: Apr. 2, 2002

(54) RING BINDER HAVING ACTUATING LEVER WITH CUSHION MEMBER

(75) Inventor: Chun Yuen To, Kauto Shan Shatin (HK)

(73) Assignee: World Wide Stationery Mfg. Co., Ltd., New Territories (HK)

( * ) Notice: Subject to any disclaimer, the term of this patent is extended or adjusted under 35 U.S.C. 154(b) by 0 days.

(21) Appl. No.: 09/539,712

(22) Filed: Mar. 31, 2000

(51) Int. Cl.[7] ..... B42F 13/20

(52) U.S. Cl. ..... 402/38; 402/41; 402/36; 402/39

(58) Field of Search ..... 402/4, 26, 31, 402/38, 41, 36, 39; 128/206.27

(56) References Cited

U.S. PATENT DOCUMENTS

| | | | | |
|---|---|---|---|---|
| 1,857,287 A | | 5/1932 | Schade | |
| 1,939,895 A | | 12/1933 | Handler | |
| 5,234,276 A | | 8/1993 | Semerjian et al. | |
| 5,354,142 A | | 10/1994 | Yu | |
| 5,393,156 A | | 2/1995 | Mullin et al. | |
| 5,788,390 A | | 8/1998 | Law | |
| 6,032,668 A | * | 3/2000 | Chung | 128/206.27 |

* cited by examiner

*Primary Examiner*—Willmon Fridie, Jr.

(57) ABSTRACT

A ring binder includes a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members. Each actuating lever includes an aperture for receiving a cushion member therein. The cushion member is engaged by the fingers of a user to pivot the actuating lever in order to move the ring members between the open position and the closed position. The cushion member is a soft pad of resilient material such as rubber or soft plastic. The cushion member provides improved tactile characteristics to the actuating lever, making the actuating lever comfortable to use. The cushion member also minimizes the feedback of undesirable shock forces produced by the snap action of the rings when opening and closing the rings.

16 Claims, 4 Drawing Sheets

RING BINDER HAVING ACTUATING LEVER WITH CUSHION MEMBER

BACKGROUND OF THE INVENTION

1. Field of the Invention

The present invention relates to a ring binder having an improved actuating lever for opening and closing rings of the ring binder, and more particularly, to an actuating lever having a cushion member for improving tactile characteristics of the actuating lever.

2. Description of the Background Art

Ring binders are known which have a substantially rigid upper plate supporting a pair of hinged leaves pivotally movable relative to each other. A number of half rings are attached to each of the hinged leaves so that pivoting of the hinged leaves will open or close the rings in a snapping motion. This motion is caused by movement of actuating levers located at each end of the ring binder.

Conventional actuating levers are typically formed of stamped metal having sufficient rigidity to transmit the forces necessary to open and close the rings. However, the snapping action produces undesirable shock forces which are transmitted to the fingers of the user. Also, because the actuating levers are formed of metal which it typically nickel plated, the actuating levers can become slippery, causing the user's fingers to slip off of the actuating lever, possibly resulting in injury to the user. Additionally, conventional actuating levers have an outwardly turned lip around most of the perimeter to rigidify and reinforce the actuating lever. This edge of the lip can be sharp and uncomfortable to press with the fingers when attempting to close the rings.

One attempt has been made to provide a cover for an actuating lever, as shown in U.S. Pat. No. 5,234,276. The purpose of the cover therein is to make metal actuating levers easier on the hands of the binder operator and/or to make the actuating levers longer so that more leverage is available. The cover is formed of two plastic pieces that are snapped together to completely encase the actuating lever. Unfortunately, the plastic cover may not fit many actuating levers, and is susceptible to breakage. In addition, because the cover completely encloses the actuating lever, the cover must be rather large and cumbersome, resulting in an unpleasant appearance.

There is a need in the art for a ring binder having an actuating lever which includes actuating levers which are comfortable to use and slip resistant, and which minimize the feedback of undesirable shock forces produced by the snap action of the rings when opening and closing the rings.

SUMMARY OF THE INVENTION

The present invention fulfills the aforementioned need in the art by providing a ring binder including a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members. Each actuating lever includes an aperture for receiving a cushion member therein. The cushion member is engaged by the fingers of a user to pivot the actuating lever in order to move the ring members between the open position and the closed position. The cushion member is a soft pad of resilient material such as rubber or soft plastic. The cushion member provides improved tactile characteristics to the actuating lever, making the actuating lever comfortable to use. The cushion member also minimizes the feedback of undesirable shock forces produced by the snap action of the rings when opening and closing the rings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENT

Figure 1:
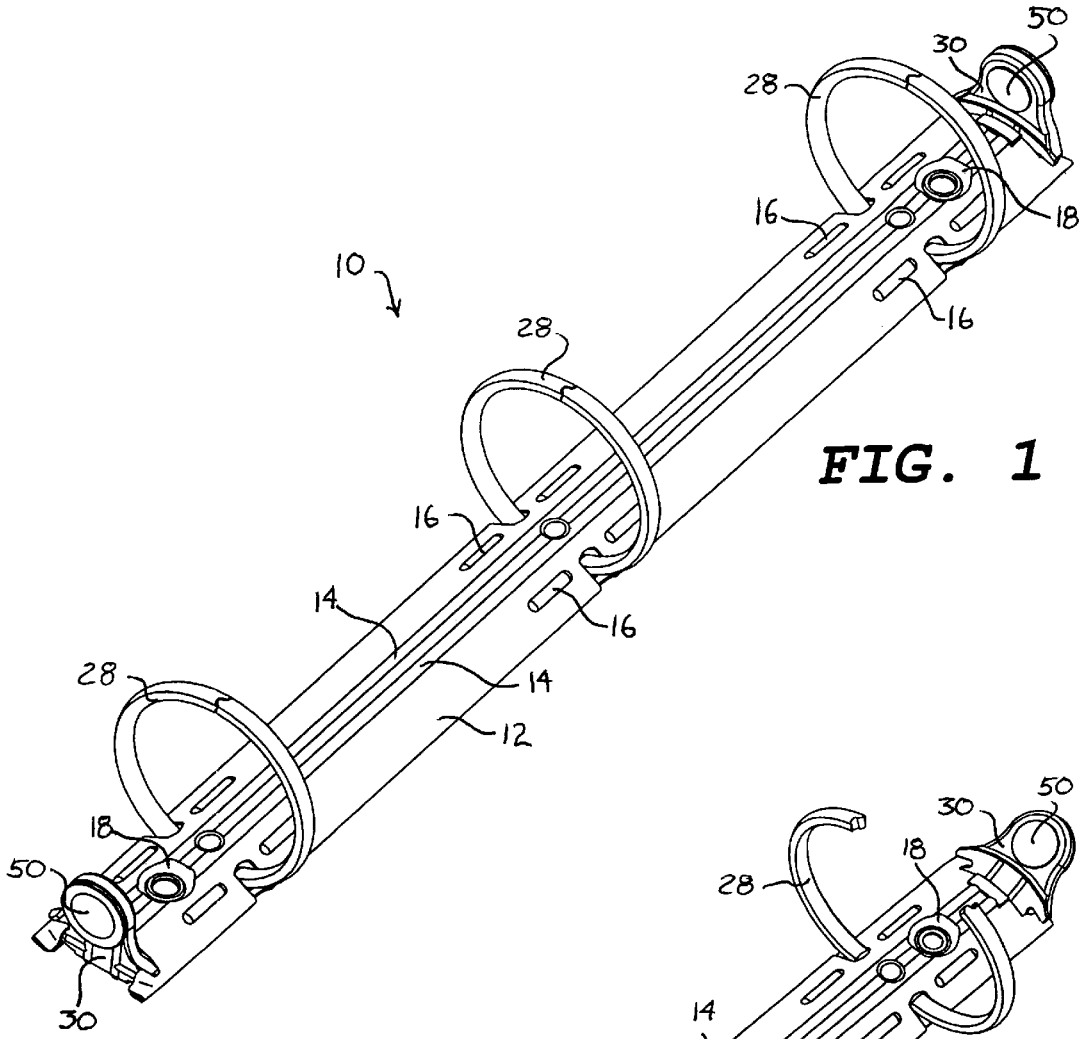
FIG. 1 is a perspective view showing the upper side of the ring binder of the present invention with the rings in a closed position.
Figure 2:
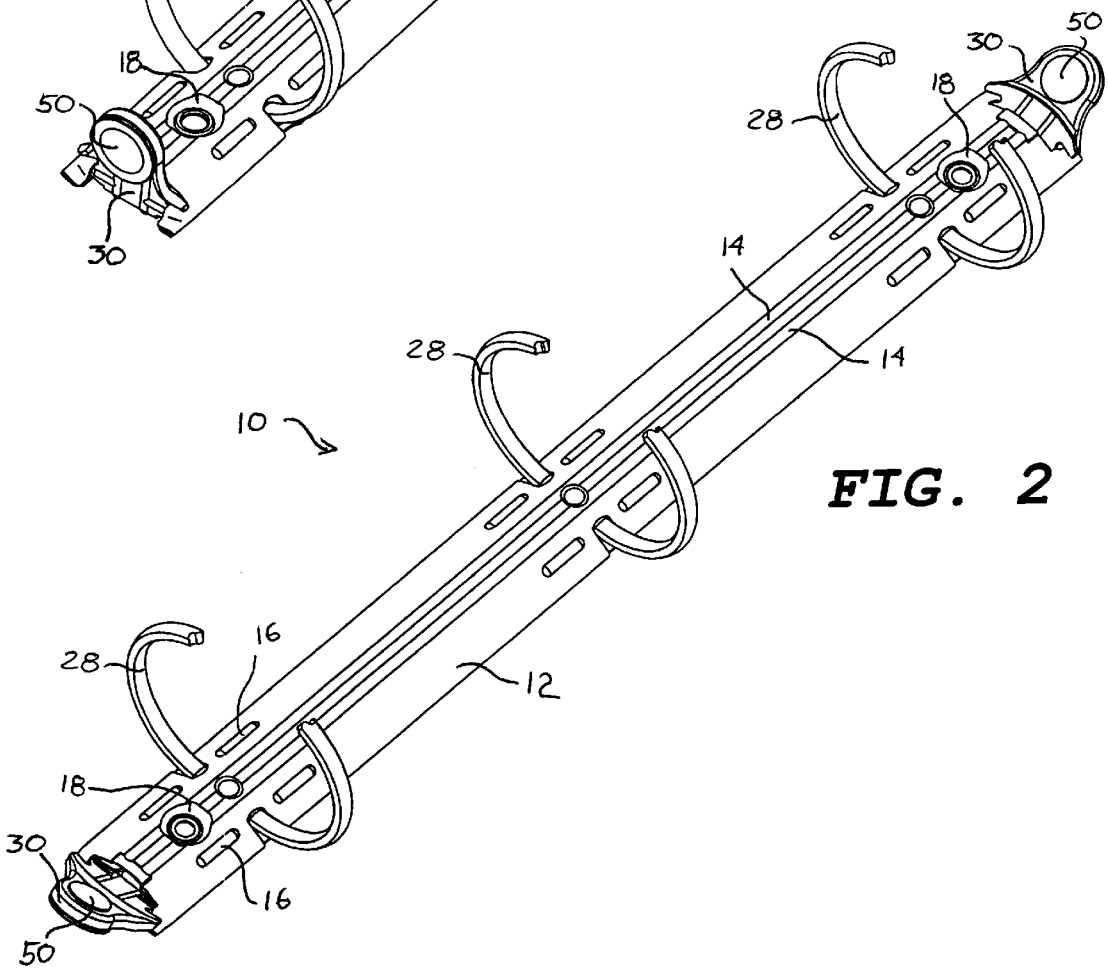
FIG. 2 is a perspective view showing the upper side of the ring binder of the present invention with the rings in an open position.
Figure 3:
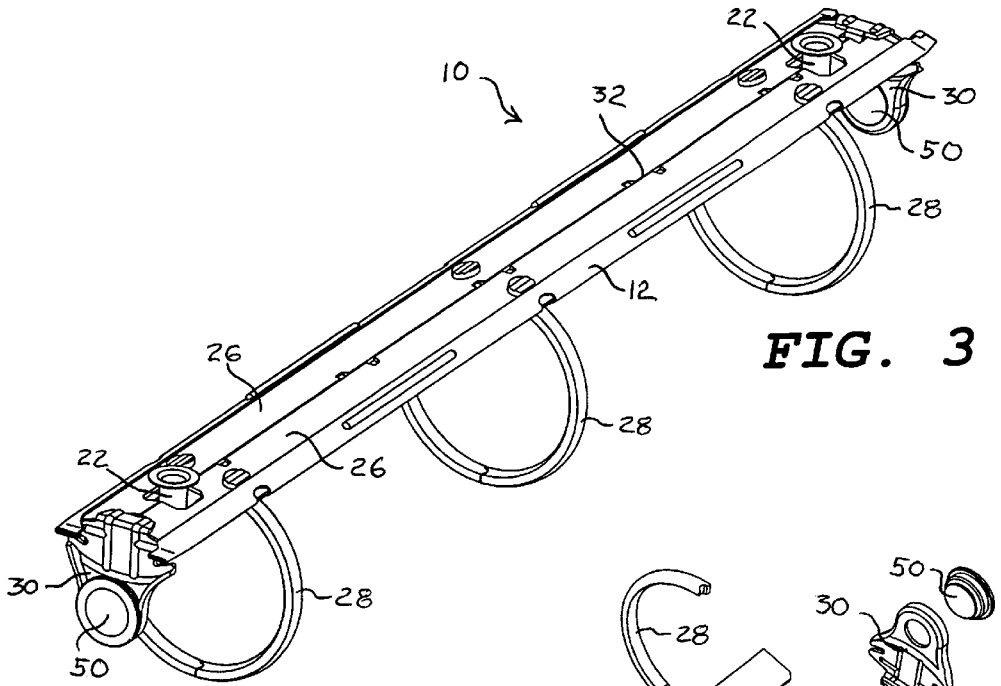
FIG. 3 is a perspective view showing the underside of the ring binder.
Figure 4:
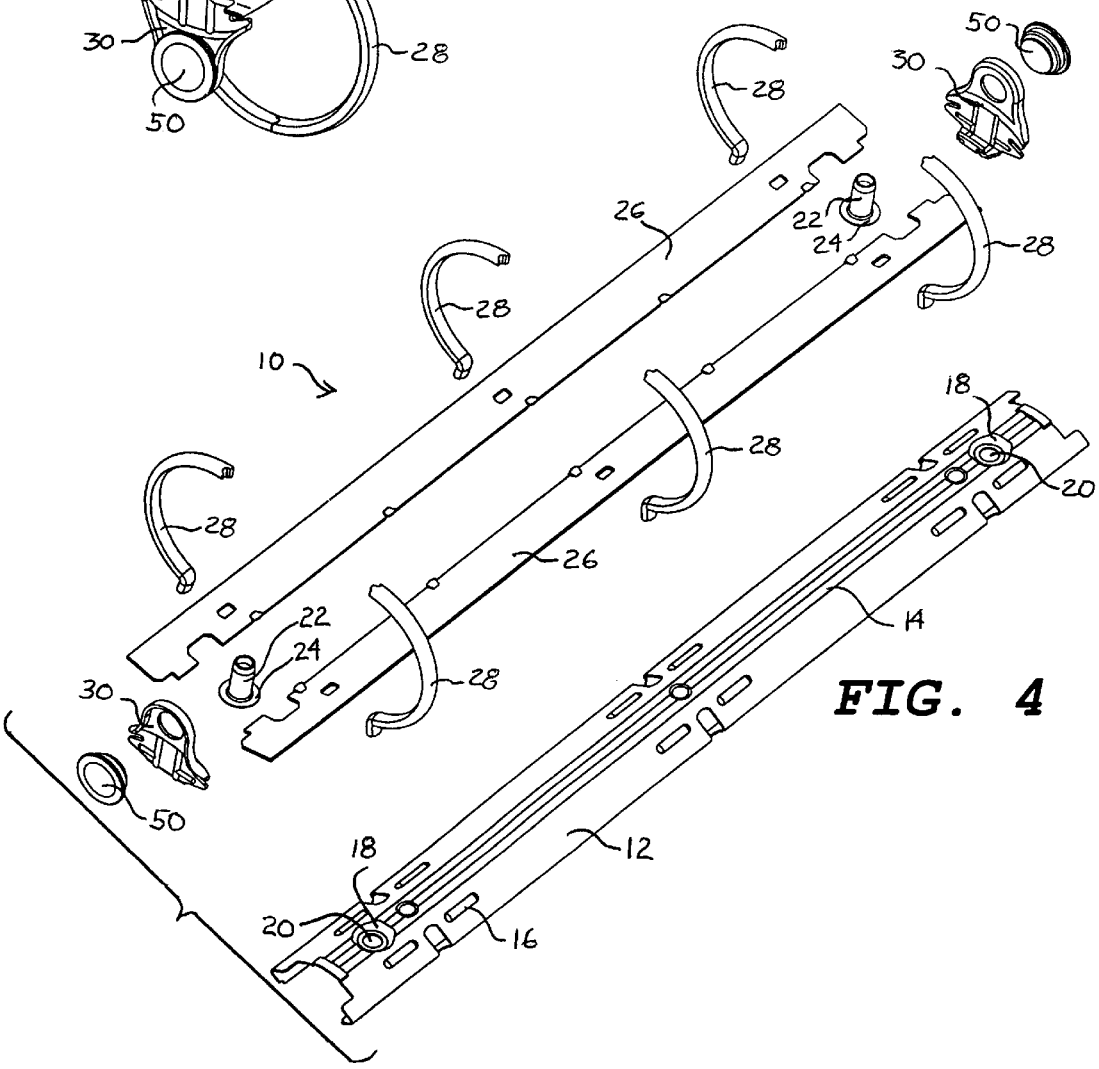
FIG. 4 is an exploded perspective view of the ring binder.
Figure 5:
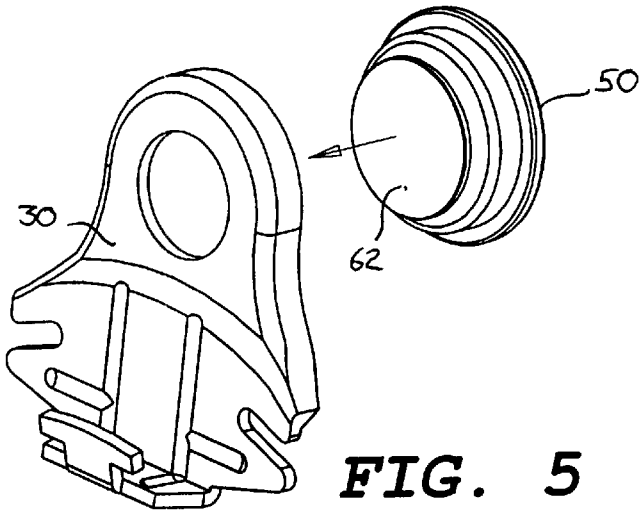
FIG. 5 is an exploded perspective view of an inner side of an actuating lever of the ring binder with a cushion member being assembled therewith.
Figure 6:
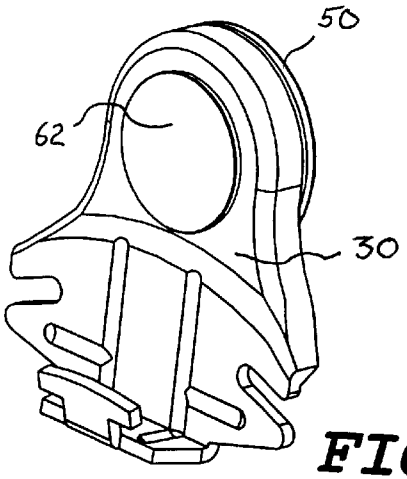
FIG. 6 is a perspective view of the inner side of the actuating lever of the ring binder with the cushion member assembled thereto.
Figure 7:
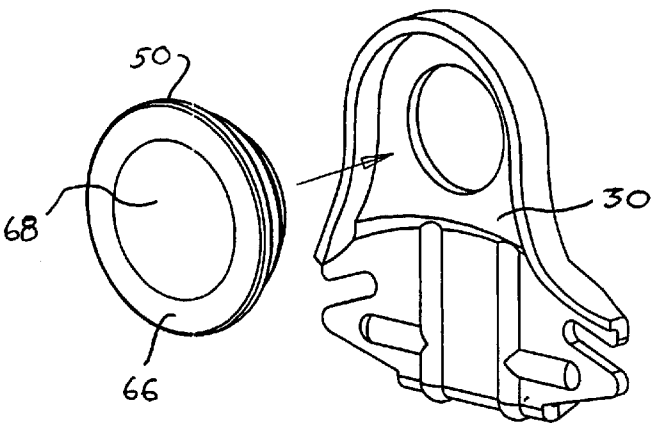
FIG. 7 is an exploded perspective view of an outer side of the actuating lever of the ring binder with the cushion member being assembled therewith.
Figure 8:
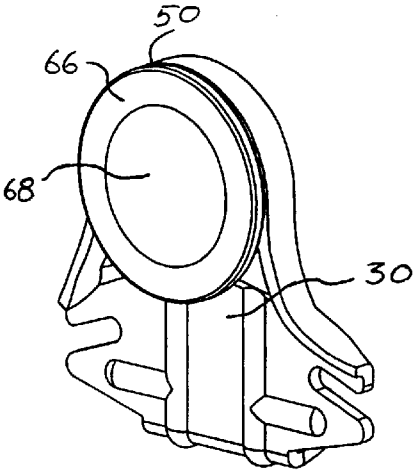
FIG. 8 is a perspective view of the outer side of the actuating lever of the ring binder with the cushion member assembled thereto.
Figure 9:
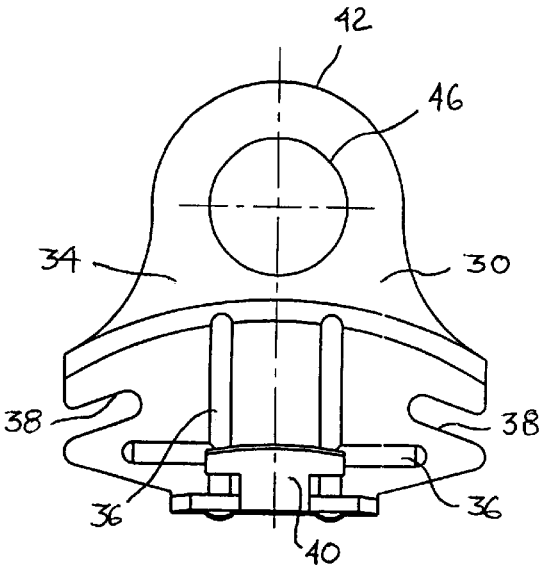
FIG. 9 is a front view of the inner side of the actuating lever.

Referring in detail to the drawings, and with particular reference to FIGS. 1–4, a ring binder of the present invention is shown. The ring binder 10 is securable to a cover member (not shown) to produce a loose-leaf binder. The cover member preferably includes a spine located between front and back covers of the cover member. The ring binder 10 may be attached to the cover member by any conventional fasteners, such as rivets, which extend through the cover member and which are deformed, for example, by punching, to securely and permanently fix the ring binder 10 to the cover member.

The ring binder 10 includes a substantially rigid curved upper plate 12. The curved upper plate 12 includes a pair of first reinforcing ribs 14 extending longitudinally along the center thereof which protrude upwardly and outwardly from an outer surface of the curved upper plate 12, thereby increasing the resistance of the curved upper plate 12 to bending. The first ribs 14 extend substantially along the entire length of the curved upper plate 12 from one end to another. The curved upper plate 12 further includes several pairs of second ribs 16 which protrude upwardly and outwardly from an outer surface of the curved upper plate 12 and which are located outwardly of the first ribs 14.

The curved upper plate 12 further includes a depression 18 near each end thereof. Each depression 18 includes an aperture 20 extending through the curved upper plate 12. A cylindrical post 22 is attached to the curved upper plate 12 at depression 18. One end of the cylindrical post 22 is secured within the aperture 20, for example, by pressing. The other end of the cylindrical post 22 has a flange 24 which forms a base for the ring binder 10 for attachment to the cover.

A pair of hinged leaves 26 are supported by the curved upper plate 12. The curved upper plate 12 provides a biasing force on the hinged leaves 26 such that the hinged leaves 26 move in an over-center manner. A plurality of ring members 28 are secured to the hinged leaves 26 for engaging corresponding holes in sheets of material retained by the ring binder 10.

An actuating lever 30 is located at each end of the curved upper plate 12 for actuating the hinged leaves 26 to open and close the ring members 28. When the ring members 28 of the ring binder 10 are in a closed position, movement of the actuating levers 30 away from one another causes a central hinge portion 32 of the hinged leaves 26 to move toward the curved upper plate 12, thereby causing the ring members 28 which move with the hinged leaves 26 to move to an open position. Conversely, when the ring members 28 of the ring binder 10 are in an open position, movement of the actuating levers 30 toward one another causes the central hinge portion 32 of the hinged leaves 26 to move away from the curved upper plate 12, thereby causing the ring members 28 to return to the closed position. A known ring binder including a conventional opening/closing mechanism with an actuating lever is more fully disclosed in U.S. Pat. No. 5,354,142, the entire contents of which are hereby incorporated by reference.

Referring now to FIGS. 5–9, an actuating lever 30 of the present invention is shown, which includes a main body 34 made of metal having a nickel plated finish. Each actuating lever 30 includes a plurality of reinforcing ribs 36 thereon to increase the rigidity of the main body 34. The main body 34 further includes a pair of grooves 38 on opposite side edges which form a pivot axis of the actuating lever 30. A lower portion of the main body 34 includes a hook member 40 which engages and moves the hinged leaves 26. An upper portion of the main body 34 is the portion engaged by the fingers of the user to pivot the actuating lever 30 about the pivot axis defined by the grooves 38, in order to open and close the ring members 28 of the ring binder 10. The upper portion of the main body 34 includes a curved perimeter edge 42 having an outwardly turned lip 44 formed around most of the curved perimeter edge 42. An aperture 46 is located in the upper portion of the main body 34.

Figure 10:
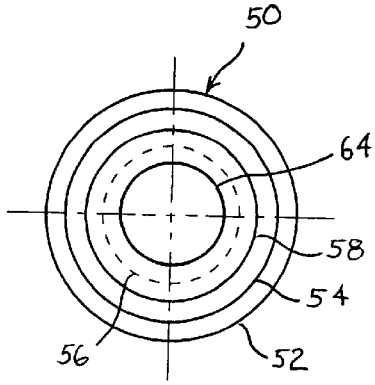
FIG. 10 is a front view of the cushion member of the present invention.
Figure 11:
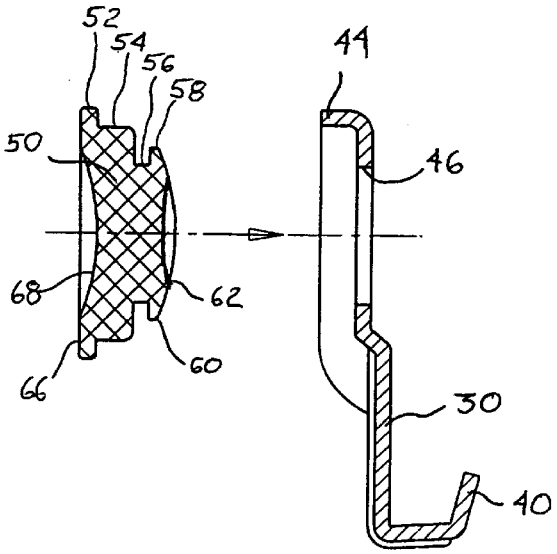
FIG. 11 is a side cross-sectional view of the cushion member being assembled with the actuating lever.
Figure 12:
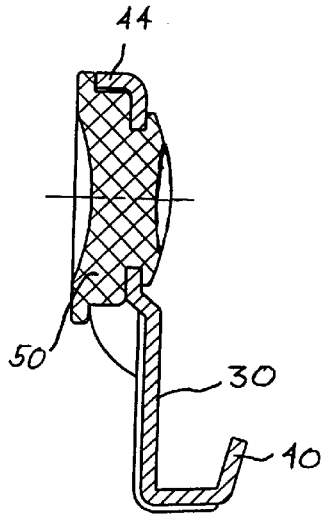
FIG. 12 is a side cross-sectional view of the cushion member assembled with the actuating lever.

Referring now to FIGS. 10–12, a cushion member 50 of the present invention is shown. The cushion member 50 is located within the aperture 46 of the actuating lever 30. The cushion member 50 is a soft pad of resilient material, which is preferably formed of rubber or soft plastic.

As shown in FIG. 11, proceeding from left to right in the figure, the cushion member 50 has a first portion 52 having a first diameter, a second portion 54 with a second diameter smaller than the first diameter, a third portion 56 with a third diameter smaller than the second diameter, and a fourth portion 58 having a fourth diameter larger than the third diameter. The diameter of the third portion 56 is approximately equal to or slightly smaller than the diameter of the aperture 46 in the actuating lever 30. The diameters of the second portion 54 and the fourth portion 58 are larger than the diameter of the aperture 46 in the actuating lever 30.

The fourth portion 58 of the cushion member 50 has a chamfered circumferential edge 60 and a convex face 62. The convex face 62 may include a dimple 64 therein. The convex face 62 of the fourth portion 58 is engaged by the finger of a user to pivot the actuating lever 30 to move the ring members 28 to the open position.

The first portion 52 of the cushion member 50 has a substantially flat face 66 having a dimple 68 therein. The flat face 66 of the first portion 52 is engaged by the finger of a user to pivot the actuating lever 30 to move the ring members 28 to the closed position.

The diameter of the first portion 52 is large enough to cover the outwardly-turned lip 44 so that the user's fingers do not touch the rough edge of the outwardly-turned lip 44, but instead touch the soft flat face 66 of the cushion member 50. The diameter of the second portion 54 is preferably sized to fit within the confines of the region bounded by the outwardly-turned lip 44, as shown in FIG. 12.

As shown in FIGS. 5–8, to install the cushion member 50, the fourth portion 58 thereof is pressed into the aperture 46 from the outer side of the actuating lever 30, compressing the diameter of the fourth portion 58 slightly and temporarily. The fourth portion 58 is pressed through the aperture 46 until it exits the aperture 46 and is located at the inner side of the actuating lever 30. The third portion 56 remains within the aperture 46, and the first portion 52 and second portion 54 remain at the outer side of the actuating lever 30.

The cushion member 50 of the present invention is preferably provided in the actuating lever 30 at the time of manufacture of the ring binder 10. Alternatively, the cushion member 50 may be applied to existing ring binders simply by drilling or punching a suitably sized hole in the actuating lever, and inserting the cushion member 50 into the hole as described above.

Although the preferred embodiment of the cushion member 50 is configured to be secured within an aperture 46 located in the actuating lever 30, it is conceived that a pair of separate cushion members could instead be secured to opposite sides of the actuating lever 30 with an adhesive, while still providing the desirable effects of the preferred embodiment.

Although the cushion member 50 is preferably formed of rubber or soft plastic, it is conceived that other cushioning materials such as leather or dense foam may be utilized. Also, the cushion member 50 may be formed of different colors to coordinate the ring binder 10 with the cover member, or with the subject matter of the items contained within the loose-leaf binder. Further, the cushion member 50 may be formed without the dimples 64,68.

Although the main body 34 of the actuating lever 30 is made of stamped metal having a nickel plated finish, it is possible to utilize other suitable strong and rigid materials, such as plastic, without departing from the invention.

It should be understood that while the preferred embodiment describes the ring binder 10 as being attached to the spine of the cover member, the ring binder may instead be attached to the front cover or the back cover. Also, although three ring members 28 are shown in FIGS. 1–4, it should be understood that any number and arrangement of ring members 28 may be utilized. For example, two or four ring members may be utilized. Also, the ring members 28 may be equally spaced apart, or may have different spacings. Finally, although the ring members 28 shown are circular, it is envisioned that D-shaped or other ring shapes may be utilized.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A ring binder comprising:

an upper plate;

a pair of hinged leaves supported by said upper plate;

a plurality of rings attached to said hinged leaves and movable therewith;

at least one pivotable actuating lever for moving said hinged leaves from a first position where said rings are closed, to a second position where said rings are open, said actuating lever including an aperture therein; and a cushion member extending through said aperture and fixed to said actuating lever, said cushion member including a first portion having a first diameter, a second portion with a second diameter smaller than said first diameter, a third portion with a third diameter smaller than said second diameter, and a fourth portion having a fourth diameter larger than said third diameter, wherein said actuating lever includes a curved perimeter edge having an outwardly turned lip formed around said curved perimeter edge, and said diameter of said first portion is large enough to cover said outwardly-turned lip.

2. The ring binder according to claim 1, wherein said second portion fits within said confines of a region bounded by said outwardly-turned lip.

3. The ring binder according to claim 2, wherein said cushion member is formed of rubber or soft plastic, said diameter of said third portion is approximately equal to or slightly smaller than a diameter of said aperture in said actuating lever, said fourth portion of said cushion member has a chamfered circumferential edge and a convex face including a dimple therein, and said first portion of said cushion member has a substantially flat face having a dimple therein.

4. The ring binder according to claim 1, wherein said cushion member is formed of rubber or soft plastic.

5. The ring binder according to claim 1, wherein said diameter of said third portion is approximately equal to or slightly smaller than a diameter of said aperture in said actuating lever.

6. The ring binder according to claim 1, wherein said fourth portion of said cushion member has a chamfered circumferential edge and a convex face.

7. The ring binder according to claim 6, wherein said convex face includes a dimple therein.

8. The ring binder according to claim 1, wherein said first portion of said cushion member has a substantially flat face having a dimple therein.

9. In combination, a ring binder having a pivotable actuating lever with an aperture therein, and a cushion member extending through said aperture and fixed to said actuating lever, said cushion member including a first portion having a first diameter, a second portion with a second diameter smaller than said first diameter, a third portion with a third diameter smaller than said second diameter, and a fourth portion having a fourth diameter larger than said third diameter, wherein said actuating lever includes a curved perimeter edge having an outwardly turned lip formed around said curved perimeter edge, and said diameter of said first portion is large enough to cover said outwardly-turned lip.

10. The combination according to claim 9, wherein said second portion fits within said confines of a region bounded by said outwardly-turned lip.

11. The combination according to claim 10, wherein said cushion member is formed of rubber or soft plastic, said diameter of said third portion is approximately equal to or slightly smaller than a diameter of said aperture in said actuating lever, said fourth portion of said cushion member has a chamfered circumferential edge and a convex face including a dimple therein, and said first portion of said cushion member has a substantially flat face having a dimple therein.

12. The combination according to claim 9, wherein said cushion member is formed of rubber or soft plastic.

13. The combination according to claim 9, wherein said diameter of said third portion is approximately equal to or slightly smaller than a diameter of said aperture in said actuating lever.

14. The combination according to claim 9, wherein said fourth portion of said cushion member has a chamfered circumferential edge and a convex face.

15. The combination according to claim 14, wherein said convex face includes a dimple therein.

16. The combination according to claim 9, wherein said first portion of said cushion member has a substantially flat face having a dimple therein.

* * * * *